US005386842A

United States Patent [19]

Becher

[11] Patent Number: 5,386,842

[45] Date of Patent: Feb. 7, 1995

[54] UMBRELLA, IN PARTICULAR LARGE UMBRELLA

[75] Inventor: Klaus Becher, Gummersbach, Germany

[73] Assignee: Becher Textil- und Stahlbau GmbH, Germany

[21] Appl. No.: 940,896

[22] PCT Filed: Feb. 25, 1992

[86] PCT No.: PCT/DE92/00153

§ 371 Date: Oct. 27, 1992

§ 102(e) Date: Oct. 27, 1992

[87] PCT Pub. No.: WO92/15217

PCT Pub. Date: Sep. 17, 1992

[30] Foreign Application Priority Data

Feb. 27, 1991 [DE] Germany ..... 4106221

[51] Int. Cl.[6] ..... A45B 13/00

[52] U.S. Cl. ..... 135/20.3; 135/25.1

[58] Field of Search ..... 135/20.3, 25.1, 25.33, 135/28, 33.2

[56] References Cited

U.S. PATENT DOCUMENTS

| | | | |
|---|---|---|---|
| 2,819,725 | 1/1958 | Deisenroth et al. | 135/20.3 |
| 3,150,671 | 9/1964 | Frey | 135/20.3 |
| 3,870,062 | 4/1974 | Medlin . | |
| 4,319,600 | 3/1982 | Roche | 135/20.3 |
| 4,424,824 | 1/1984 | Becher . | |
| 4,637,415 | 1/1987 | Dalo et al. | 135/20.3 X |

FOREIGN PATENT DOCUMENTS 2803857 1/1978 Germany .

*Primary Examiner*—Lanna Mai

*Attorney, Agent, or Firm*—Diller, Ramik & Wight

[57] ABSTRACT

In the case of an umbrella, in particular a large umbrella, garden umbrella, stand umbrella and the like, having an umbrella pole (2), a pole part (3) which is displaceable telescopically with the umbrella pole (2) and on which roof rods (5) are articulated by means of a crown (4), and having supporting struts (7) between a runner (6), displaceable along the umbrella pole (2), and the roof rods (5), as well as having a roof covering (21), the movements of the displaceable pole part (3) and of the runner (6) taking place in forced dependence on each other and the displaceable pole part (3) being in connection with a threaded spindle mounted in the umbrella pole (2) and the runner (6) being connected to the pole part (3) by a flexible drawing element led over a deflection roller, to produce a kind of pagoda shape there is provided a further displaceable crown (20) as upper crown, on which the roof covering (21), fastened to the roof rod ends, is attached, and the upper crown (20) has stay crutches (22) or the like, the lower end of which is guided by a common guide part (23) along the pole part (2).

20 Claims, 5 Drawing Sheets

UMBRELLA, IN PARTICULAR LARGE UMBRELLA

BACKGROUND OF THE INVENTION

The invention relates to an umbrella, in particular a large umbrella, garden umbrella, stand umbrella and the like, having an umbrella pole, a pole part which is displaceable telescopically in the umbrella pole and on which roof rods are articulated by means of a crown, and having supporting struts between a runner, displaceable along the umbrella pole, and the roof rods, as well as having a roof covering. The displaceable pole part is in connection with a threaded spindle, mounted in the umbrella pole, and the runner is connected to the pole part by means of a flexible drawing element led over a deflection roller.

Such an umbrella is described, for example, in U.S. Pat. No. 4,424,824. In the case of such a configuration of the umbrella, it is possible to be able to displace the pole part, which is slidingly mounted in the umbrella pole and bears the roof rods, by exerting a small force, and thereby forcibly raise the runner and, by means of the supporting struts, bring the roof rods into the open position and, in this position, support them. The movements of the pole part and of the runner are opposite each other. For opening the umbrella, the pole part is lowered by means of the threaded spindle, whereas the runner is raised by the flexible drawing element. For closing the umbrella, the telescopic pole part is moved upward, whereas the runner slides downward on the umbrella pole. The displacing of the runner downward takes place by the dead weight of the same and by the proportionate weight of the supporting struts and of the roof rods. The manual actuating mechanism is preferably used for umbrellas of which the span is 4 to 8 m in diameter. What is essential here is that an umbrella is obtained of which the umbrella roof can be tensioned extremely tautly when the umbrella is opened.

U.S. Pat. No. 3,870,062 discloses an umbrella which has a roof skin tensioned in the manner of a pagoda and is provided with an upper crown. The latter is rigidly connected to the displaceable pole part, the roof rods being telescopic.

SUMMARY OF THE INVENTION

The object of the invention is to develop an umbrella of said type further in such a way that an umbrella is obtained of which the umbrella roof runs more or less concavely from the umbrella tip to the roof rod ends, so that a kind of pagoda shape is produced. In this case it is important that the umbrella roof is under tension from the umbrella tip to the roof rod ends.

The invention is distinguished by the fact that a further crown, displaceable along the pole part, is provided as upper crown, on which the roof covering, fastened to the roof rod ends, is attached, that the upper crown has stay crutches, the lower ends of which are guided by a common guide part along the pole part and that an annular rest is provided on the umbrella pole as support for the guide part.

Such a design of the umbrella of the type described at the beginning achieves the effect that, by simple means, an umbrella is obtained which, as a kind of pagoda, has an umbrella roof which is under considerable tension, without any folds, the pagoda umbrella having a high stability mechanically and aerodynamically. The umbrella receives an intrinsic rigidity and an intrinsic stability, without additional pretensioning forces having to be introduced. A completely equal tensioning of the umbrella covering is attained with the normal tensioning of the umbrella roof. The means for this are constructionally simple. Just a few additional parts suffice. As in the case of a normal umbrella of this type, the opening and closing of the umbrella can be easily carried out.

According to the further features of the invention, upper crowns [sic], stay crutches and guide part form a rigid, stable composite part. The stay crutches may be led through bores and the like at the roof rod crown, so that a physical hindrance cannot occur during opening and closing of the umbrella.

The annular rest is expediently arranged at the upper end of the umbrella pole. This rest can be given receiving elements for the stay crutch ends, the receiving elements being vertically adjustable. The stay crutches expediently have stops for limiting the displacement of the upper crown. Such stops preferably comprise thickened portions of the crutches.

To support the pagoda shape, it may be provided that the radial segments of the textile roof covering are cut to run more or less concavely on the longitudinal sides of the triangular structure.

The invention is explained below with reference to an illustrative embodiment represented in the drawing:

DESCRIPTION OF THE PREFERRED EMBODIMENTS

Figure 1:
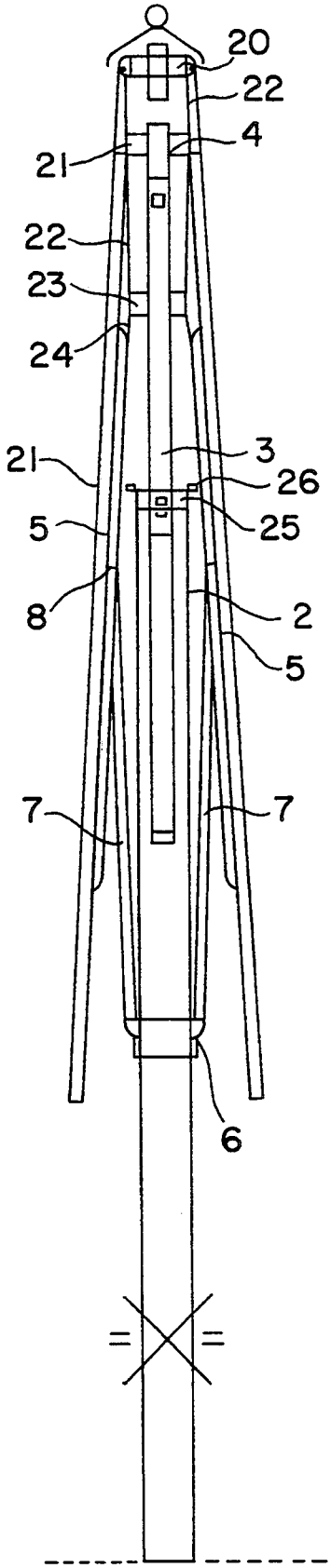
FIG. 1 shows the umbrella according to the invention in the closed position and in diagrammatic form.
Figure 2:
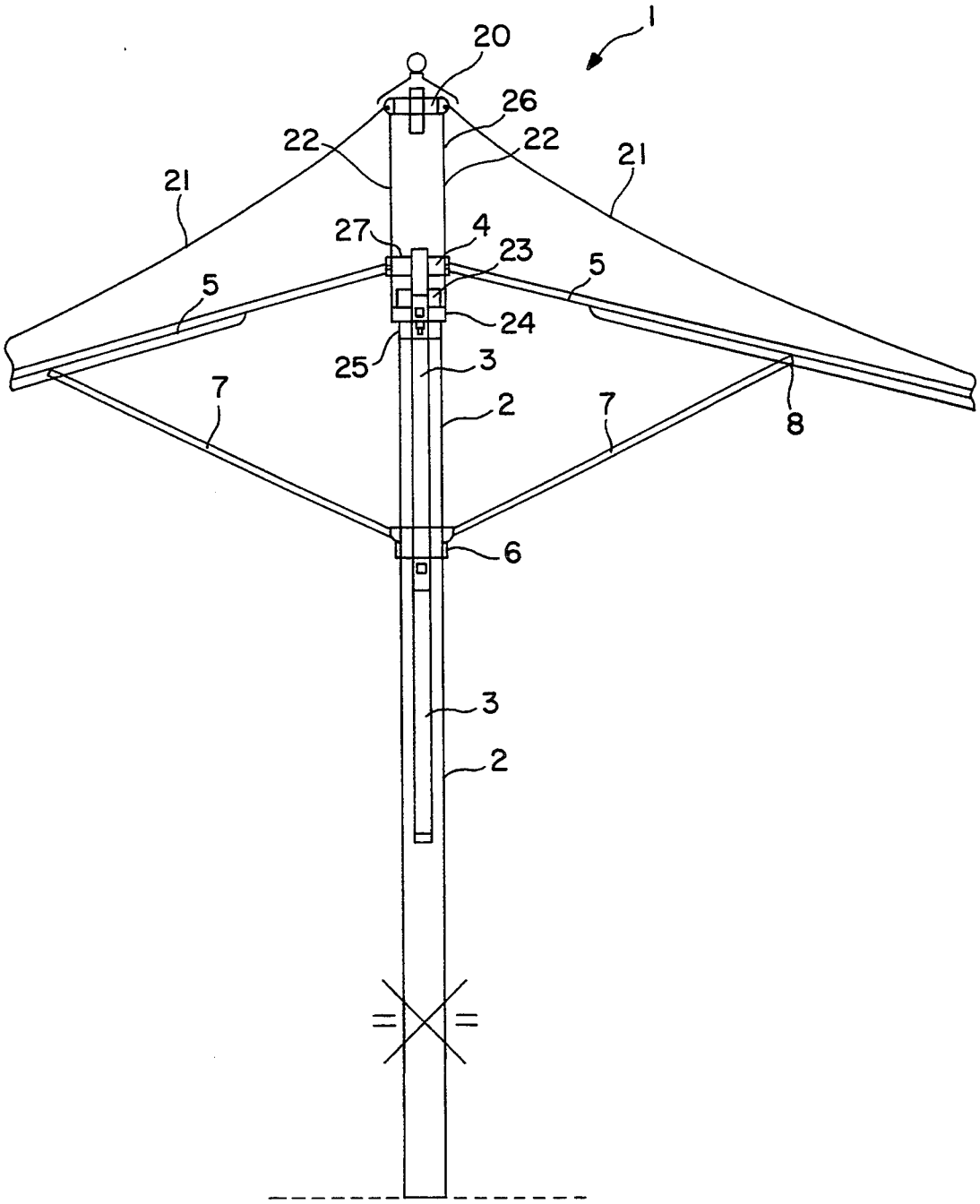
FIG. 2 represents the umbrella of FIG. 1 in the opened position diagrammatically, FIGS. 3+4 as well as FIGS. 5+6 illustrate the drive device for the umbrella of the invention diagrammatically in elevation and in side view, FIGS. 3 and 4 representing the parts with the umbrella opened and FIGS. 5 and 6 representing the corresponding parts of the drive with the umbrella closed.
Figure 6:
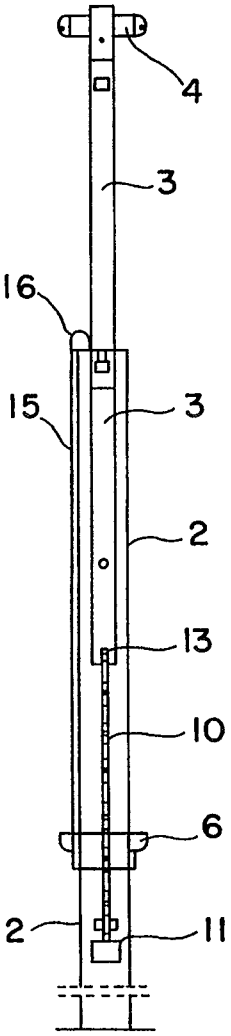
Figure 5:
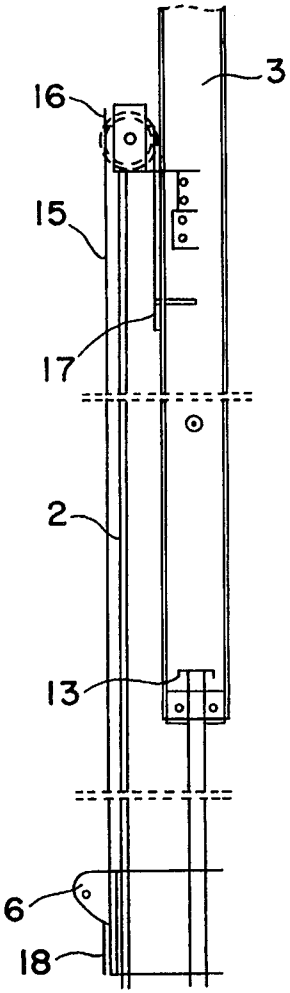
Figure 4:
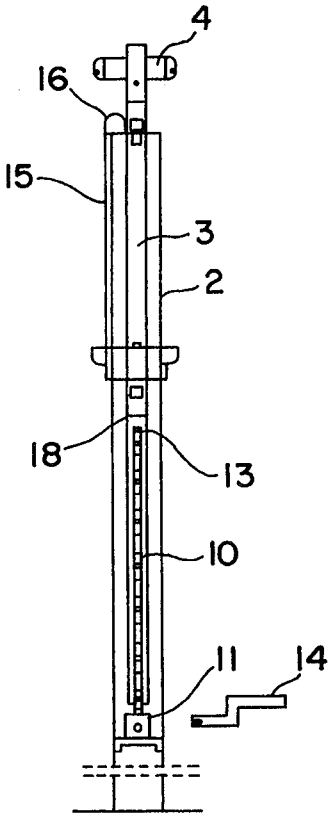
Figure 3:
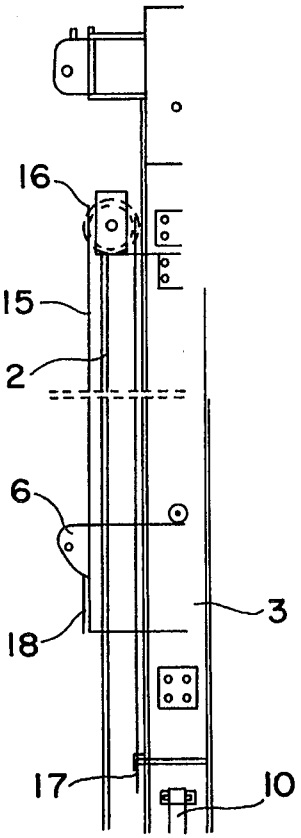
Figure 7:
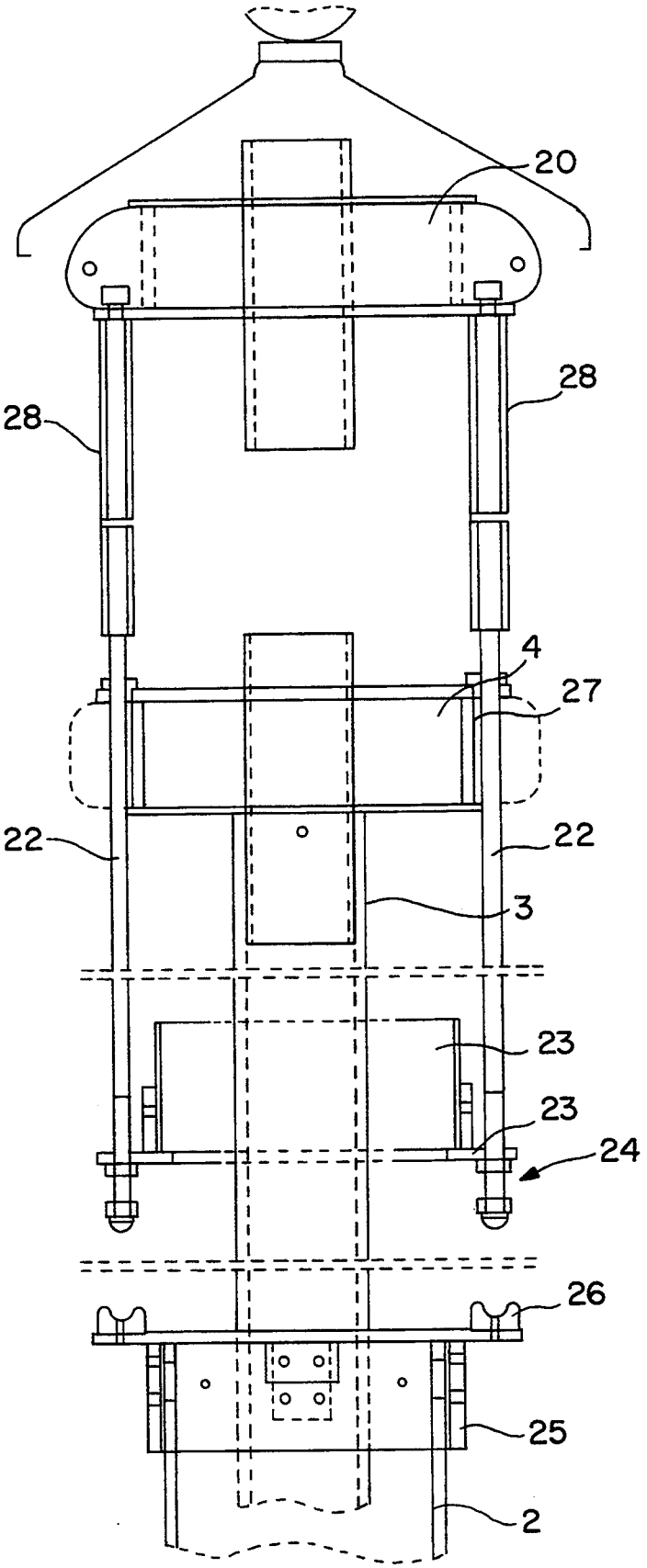
FIG. 7 shows the system of arrangement of the upper crown on an enlarged scale and in diagrammatic form, FIG. 8 gives a phased overview of the movement of the upper crown from the closed umbrella to the opened umbrella in elevation and in diagrammatic form.
Figure 8:
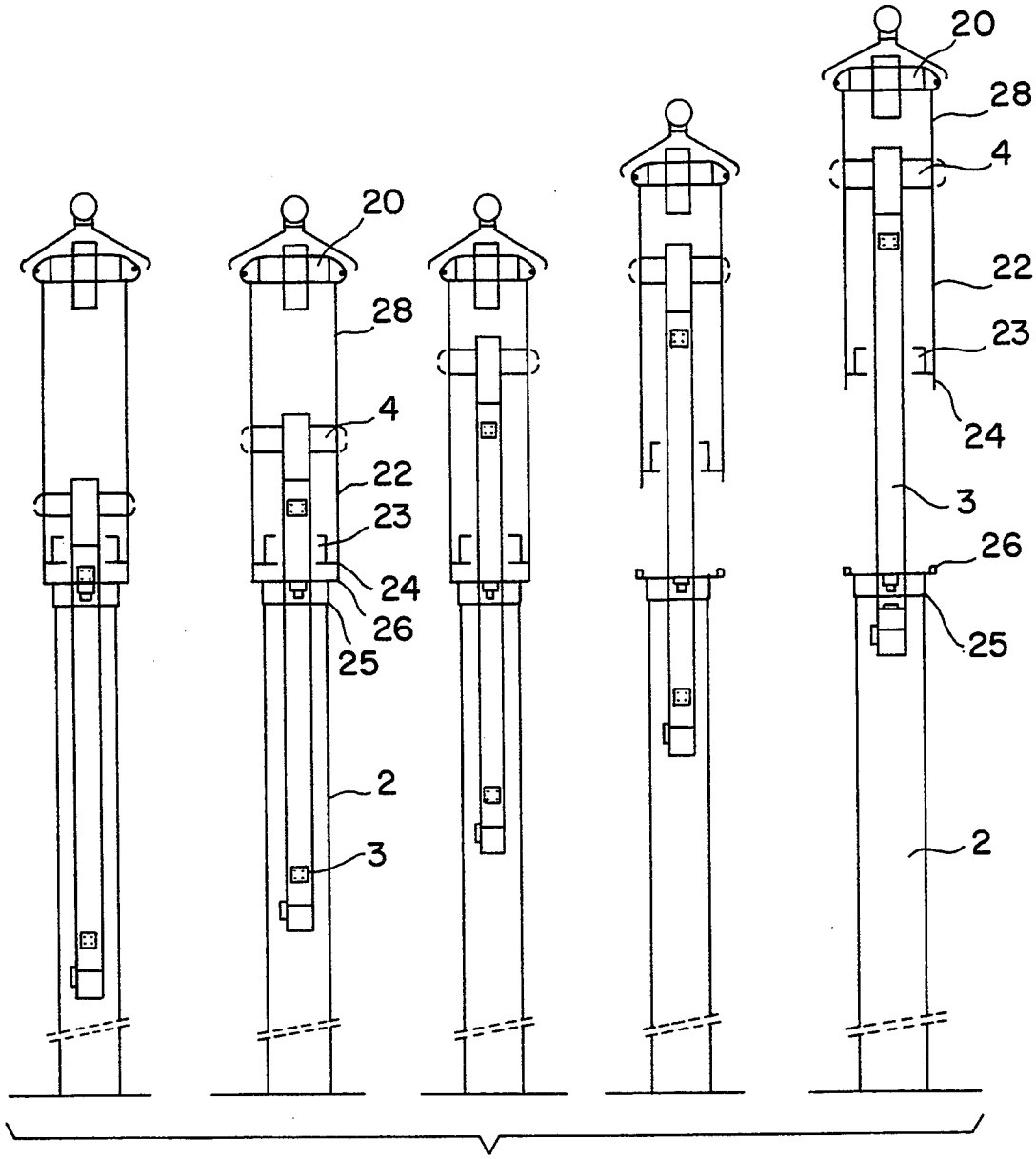

In the case of FIG. 1, on which the invention is based, an umbrella 1 includes an umbrella pole 2 in which there is a pole part 3 which is displaceable telescopically in umbrella pole 2 and at the upper end of which there is attached a crown 4, on which the roof rods 5 are articulated. Arranged slidably along the umbrella pole 2 is a runner 6, articulated on which are supporting struts 7 which act by their other end 8 jointedly on the roof rods 5.

For actuating the umbrella or umbrella framework 1, a threaded spindle 10 is provided, which is mounted undisplaceably at the lower end on an angular gear 11. The threaded spindle 10 is advantageously designed as a trapezoidal threaded rod. The angular gear 11 is mounted in a locationally fixed manner in the umbrella pole 2 on a holding means 12, which is fastened to the umbrella pole 2. The angular gear may, for example, comprise a worm and a worm wheel which is connected in a rotationally fixed manner to the threaded spindle 10. Arranged on the threaded spindle 10 is a threaded nut 13, which is fastened to the pole part 3. The threaded spindle 10 can be turned by means of a hand crank 14. The pole part 3 and the runner 6 are in connection with each other via a flexible drawing element 15, which runs over a deflection roller 16. The flexible drawing element 15 is preferably a wire line; a but chain or the like may also be used. One end of the drawing element 15 is fixedly attached to the pole part 3 by means of a fastening element 17, for example a screw or the like, whereas the other end of the drawing element 15 is fixedly connected to the runner 6 at 18.

For opening the umbrella, the spindle 10 is set in rotation by means of the hand crank 14 via the angular gear 11. As a result, the threaded nut 13 slides downward and draws the displaceable pole part 3 downward in the direction of the umbrella pole 2. At the same time, the runner 6 is raised on the umbrella pole 2 by means of the drawing element 15, whereby the spreading of the roof rods 5 by means of the supporting struts 7 is assisted. The roof rod crown 4 is lowered.

In the case of the umbrella 1 there is provided a further crown, i.e. an upper crown 20, on which alone the roof covering 21 is fastened or suspended, whereas the lower edge of the roof covering 21 is connected to the ends of the roof rods 5. Located on the upper crown 20 is a stay crutch unit 24 defined by several stay crutches 22, for example four in number, which are fixedly connected to the upper crown 20 and are vertically displaceable with the roof covering 21. The lower ends of the stay crutches 22 are connected to a plate piece 23. Upper crown 20, stay crutches 22 and the plate piece or stabilizing plate 23 form the stay crutch unit 24 which is stable in itself and can be displaced vertically as a whole. The lower ends (unnumbered) of the stay crutches 22 projecting below the plate piece 23 and define feet (unnumbered). At the upper end of the umbrella pole 2 there is arranged an annular rest 25. The rest 25 has receiving elements or bearings 26 for receiving the stay crutch feet, the receiving elements 26 being vertically displaceable. The receiving elements 26 are advantageously run-in-centering, elastically dampening, upwardly open receiving bearings. The lower ends or feet of the stay crutches 22 run into these and gently come to bear upon opening of the umbrella 1. The lower ends of the stay crutches 22 are on the one hand designed in such a way that, on running into and coming to bear on the receiving bearings 26, they are centered and forcibly guided, on the other hand they can be adjusted vertically in a fine-setting range. The vertical adjustability of the stay crutch ends serves to optimize the body shape of the opened umbrella. The stay crutches 22 pass through bores 27 of the roof rod crown 4.

The stay crutches 22 are provided at a desired height with stops or stop elements 28, which limit the displaceability of the roof rod crown 4. The stops 28 preferably comprise thickened portions of the stay crutches 22 themselves at the point concerned.

By the hand crank 15, the nut 13 and the mechanism or gear 11 inside the outer, non-movable umbrella pole 2, the threaded spindle 10 flange-mounted on the gear 11 draws the inner pole part 3 further downward into the outer umbrella pole 2. As a result, initially the two crowns shift downward jointly, i.e. in the same distance.

Since the runner 6 is connected to the lower end of the inner movable pole part 3 by the flexible drawing element or line 15, which is guided and led by means of the line roller or deflection roller 16 stationarily attached at the upper end of the outer, nonmovable umbrella pole 2, the lowering of the inner pole part 3 along with the crowns 4,20 at the same time effects the raising of the runner 6. 4,20 and runner 6 thus have opposite movement.

The spreading of the supporting struts 7 and the upward movement of the runner 6 on the one hand and the simultaneous spreading of the roof rods 5 by the downward movement of the roof rod crown on the other hand is the consequence. As soon as, in the course of the joint downward movement of the two crowns 4 and 20, the lower ends or feet of the stay crutches 22 are stopped in their downward movement by coming to bear in the receiving elements 26 the upper crown 20 comes to a standstill, that is to say is not lowered any further, whereas the roof rod crown 4 continues to shift downward, i.e. during the enforced approaching of the roof rod crown 4 and the runner 6.

During this further lowering of the roof rod crown 4 alone—with respect to the two crowns—and the simultaneous raising and spreading of the outer ends of the roof rods 5—both in relation to the upper crown remaining spatially stationary—the initially visibly excessive length over which the roof covering 21 extends between the outer ends of the roof rods 5 on the one hand and the corresponding radially arranged fastening points on the upper crown 20 on the other hand is reduced steplessly. As soon as the radial arc length of the roof covering 21 corresponds to the associated secant line (straight line between roof rod end and counter point of the upper crown) during the further opening operation, although the umbrella roof body shape of the pagoda is achieved according to the recognizable shape principle, the umbrella roof covering 21 is still not tensioned, but only pretensioned. This is on account of the fact that residual cranking displacements (certain distance between upper edge of runner and mechanical stop 25 fixedly attached on the outer umbrella pole) have visibly remained unexploited or else an appreciable manual crank resistance is not perceptible. In spite of a clear body shape, the roof surface area still has a multiplicity of relatively small folds. The roof edge arcs of one roof bar end to the next of the roof covering, as well as the textile valance or side panels for instance fixedly attached to the roof bar arcs are not yet stretched.

During the remaining cranking, i.e. opening process, the progressively increasing manual crank resistance is felt. The still further changing geometry of the roof construction against the upper crown 20, remaining spatially stationary, effects a complete, fold-free tensioned opening out of the roof covering 21, the full stretching of the roof edge arcs and any attached textile side panels, with recognizably higher mechanical material tensioning (peripheral pretensioning), a distinctly visible (incidentally also audible—clear reverberating effect when one speaks underneath the umbrella) high material tensioning along the radial line of curvature with respect to the upper crown 20 (radial pretensioning) and a distinctly visible, idealized or optimized shape of the overall roof or umbrella body (pagoda).

Upon closing of the umbrella 1, the roof body or roof covering 21 relaxes increasingly with each revolution of the hand crank. An excess of length in the extents or lines of material covering between the roof rod ends and their opposed fastening points on the upper crown occurs. Upper crown 20 along with stay crutches 22 and stabilizing plate 23 initially do not move upward; only when the roof rod crown with the passage bores located in it strikes against the lower edge of the stop elements 28 of the stay crutches 22 is the upper crown 20 also raised. This means that the roof rod crown 4 drives the upper crown 20 upward along with it. The two parts continue to move upward jointly with a constant vertical distance between them. At the driver point concerned, the above-mentioned excess of length in the material of the roof covering 21 is systematically used up again. It disappears as soon as the umbrella 1 is closed. The excesses of length concerned occur only temporarily in each case during the opening and closing operation.

The radial textile segments of the umbrella 1 or the roof covering 21 of the umbrella 1, pagoda-shaped in the opened final form in which it appears, are not triangularly cut in their planar developed view and put together; rather, all three sides of an imaginary isosceles triangle are cut concavely in relation to the surface area of the triangle. The concavely cut side of a roughly triangular radial segment thus has the mirror-invertedly concavely cut side of the next adjoining, likewise roughly triangular radial roof segment lying opposite it. The forcible mechanical connection of such diametrically concavely contoured or cut sides among one another and, furthermore, the connection of all such contoured cut radial segments to form the complete roof covering produces, in complex interaction with the roof construction on the one hand and the specific induction of mechanical tensioning forces in the system-radial direction and system-peripheral direction on the other hand, the geometrically ideal shape of the pagoda on the fully opened and tensioned umbrella body. Although a preferred embodiment of the invention has been specifically illustrated and described herein, it is to be understood that minor variations may be made in the apparatus without departing from the spirit and scope of the invention, as defined the appended claims.

I claim:

1. An umbrella comprising an umbrella pole (2), a pole part (3) displaceable telescopically relative to said umbrella pole (2), a first crown (4) carried by an upper end portion of said pole part (3), a plurality of roof rods (5) connected for articulated movement to said first crown (4), a plurality of supporting struts (7) having opposite first and second end portions connected respectively to said roof rods (5) and a runner (6) displaceable along said umbrella pole (2), a stay crutch unit (24) carrying a second crown (20) and including a plurality of stay crutches (22), a roof covering (21) connected between said second crown (20) and said roof rods (5), a threaded spindle (10) within said umbrella pole (2), said threaded spindle (10) carrying a threaded member (13) selectively movable in opposite directions along said threaded spindle (10) upon selective rotation of said threaded spindle (10), a deflection roller (16) carried by said umbrella pole (2), a flexible drawing element (15) entrained about said deflection roller (16) and having opposite ends connected to said threaded member (13) and said pole part (3) respectively, said crutch unit (24) being displaceable relative to said pole part (3), means (23) for guiding said stay crutches (22) during displacement of said crutch unit (24) relative to said pole part (3), and means (25) carried by said umbrella pole (2) for supporting said stay crutch unit (24) at least in one of closed and open positions of the umbrella.

2. The umbrella as defined in claim 1 wherein said second crown (20), stay crutches (22) and guiding means (23) collectively define said crutch unit (24) as a relatively rigid and stable construction.

3. The umbrella as defined in claim 2 including further means (27) for guiding the movement of said stay crutches (22) relative to said first crown (4).

4. The umbrella as defined in claim 2 including further means (27) for guiding the movement of said stay crutches (22) relative to said first crown (4), and said further guiding means (27) are bores slidably receiving said stay crutches (22).

5. The umbrella as defined in claim 2 wherein said supporting means (25) is carried by an upper end portion of said umbrella pole (2), and said supporting means (25) includes seat means (26) for each receiving an end of said stay crutches (22).

6. The umbrella as defined in claim 2 wherein said supporting means (25) is carried by an upper end portion of said umbrella pole (2), said supporting means (25) includes seat means (26) for each receiving an end of said stay crutches (22), and means for vertically adjusting said seat means (26).

7. The umbrella as defined in claim 2 including means for adjusting the length of said stay crutches (22).

8. The umbrella as defined in claim 2 including mean (28) for limiting the displacement of said second crown (20).

9. The umbrella as defined in claim 1 including further means (27) for guiding the movement of said stay crutches (22) relative to said first crown (4).

10. The umbrella as defined in claim 9 including mean (28) for limiting the displacement of said second crown (20).

11. The umbrella as defined in claim 1 including further means (27) for guiding the movement of said stay crutches (22) relative to said first crown (4), and said further guiding means (27) are bores slidably receiving said stay crutches (22).

12. The umbrella as defined in claim 1 wherein said supporting means (25) is carried by an upper end portion of said umbrella pole (2), and said supporting means (25) includes seat means (26) for each receiving an end of said stay crutches (22).

13. The umbrella as defined in claim 12 including mean (28) for limiting the displacement of said second crown (20).

14. The umbrella as defined in claim 12 including mean (28) for limiting the displacement of said second crown (20), and said displacement limiting means (28) includes an enlarged portion of at least one of said stay crutches (22).

15. The umbrella as defined in claim 1 wherein said supporting means (25) is carried by an upper end portion of said umbrella pole (2), said supporting means (25) includes seat means (26) for each receiving an end of said stay crutches (22), and means for vertically adjusting said seat means (26).

16. The umbrella as defined in claim 1 including means for adjusting the length of said stay crutches (22).

17. The umbrella as defined in claim 1 including mean (28) for limiting the displacement of said second crown (20).

18. The umbrella as defined in claim 1 including mean (28) for limiting the displacement of said second crown (20), and said displacement limiting means (28) includes an enlarged portion of at least one of said stay crutches (22).

19. The umbrella as defined in claim 1 wherein said roof covering (21) is defined by a plurality of radial segments.

20. The umbrella as defined in claim 1 including means (27) defined by said first crown (4) for slidably guiding said stay crutches (22) relative to said first crown (4).

* * * * *